US009585501B1

(12) United States Patent
Hamelink et al.

(10) Patent No.: US 9,585,501 B1
(45) Date of Patent: Mar. 7, 2017

(54) BEVERAGE CUP INSULATING SEAL MEMBER AND ASSOCIATED INSULATED BEVERAGE CUP ASSEMBLY

(71) Applicants: L. Robert Hamelink, Hamilton, MI (US); Andrew Ruiter, Grand Haven, MI (US)

(72) Inventors: L. Robert Hamelink, Hamilton, MI (US); Andrew Ruiter, Grand Haven, MI (US)

( * ) Notice: Subject to any disclaimer, the term of this patent is extended or adjusted under 35 U.S.C. 154(b) by 25 days.

(21) Appl. No.: 14/077,786

(22) Filed: Nov. 12, 2013

(51) Int. Cl.
*B65D 81/38* (2006.01)
*A47G 19/22* (2006.01)

(52) U.S. Cl.
CPC ..... *A47G 19/2205* (2013.01)

(58) Field of Classification Search
CPC .. A47G 19/2288; B65D 1/265; B65D 81/3869
USPC ..... 220/739, 592.27, 592.17
See application file for complete search history.

(56) References Cited

U.S. PATENT DOCUMENTS 723,796 A * 3/1903 Williams ..... 220/592.17
2,316,150 A * 4/1943 Amberg ..... 229/400
2,563,352 A * 8/1951 Morse ..... 206/515
2,591,578 A * 4/1952 McNealy et al. ..... 229/403
2,622,415 A * 12/1952 Smith et al. ..... 62/457.3
2,725,733 A * 12/1955 Davis ..... 215/12.1
2,828,903 A * 4/1958 Adkins ..... 229/403
2,863,585 A * 12/1958 Meshberg ..... 220/592.17
2,899,098 A * 8/1959 Gits ..... 220/592.17
3,079,027 A * 2/1963 Edwards ..... 206/519
3,094,240 A * 6/1963 Wanderer ..... 206/519
RE25,618 E * 7/1964 Goodman ..... 220/592.17
3,353,707 A * 11/1967 Eyles ..... 206/519
3,365,092 A * 1/1968 Blessing ..... 220/23.88
3,372,830 A * 3/1968 Edwards ..... 206/519
3,374,922 A * 3/1968 Shelby ..... 206/519
3,443,714 A * 5/1969 Edwards ..... 220/671
3,456,860 A * 7/1969 Janninck ..... 229/400
3,612,346 A * 10/1971 Schneider ..... 206/519
3,648,888 A * 3/1972 Cheladze ..... 206/519
3,677,524 A * 7/1972 Douglas ..... 366/130
3,759,437 A * 9/1973 Amberg ..... 229/400
3,765,559 A * 10/1973 Sauey et al. ..... 220/592.16
3,850,361 A * 11/1974 Day et al. ..... 229/400
4,007,670 A * 2/1977 Albano et al. ..... 493/95
4,040,537 A * 8/1977 Edwards ..... 206/520
4,151,923 A * 5/1979 Bernardi ..... 215/12.1
4,231,476 A * 11/1980 Compton et al. ..... 206/519
4,485,636 A * 12/1984 Hilado ..... 62/430

(Continued)

*Primary Examiner* — Jeffrey Allen
(74) *Attorney, Agent, or Firm* — King & Partners, PLC

(57) ABSTRACT

An insulating seal member adapted for use in association with a pair of beverage cups including an annular body, wherein the annular body includes: an upper region having an inner surface, an outer surface, and a top surface; a lower region having an inner surface, an outer surface, and a bottom surface; and an intermediate region positioned between the upper and lower regions; wherein the top surface of the upper region is adapted to sealingly engage a bottom surface of an annular rim of a first beverage cup; and wherein at least one of a lower surface of the intermediate region and the bottom surface of the lower region is adapted to sealingly engage a top surface of an annular rim of a second beverage cup positioned below the first beverage cup.

1 Claim, 8 Drawing Sheets

(56) References Cited

U.S. PATENT DOCUMENTS

| | | | | |
|---|---|---|---|---|
| 4,534,391 | A | 8/1985 | Ventimiglia et al. | |
| 4,548,348 | A * | 10/1985 | Clements | 220/738 |
| 4,551,366 | A * | 11/1985 | Maruhashi et al. | 229/123.1 |
| 4,671,424 | A | 6/1987 | Byrns | |
| 4,747,507 | A | 5/1988 | Fitzgerald et al. | |
| 4,993,580 | A | 2/1991 | Smith | |
| 5,076,463 | A * | 12/1991 | McGraw | 220/592.17 |
| 5,145,107 | A * | 9/1992 | Silver et al. | 229/403 |
| 5,190,157 | A * | 3/1993 | Przytulla | 206/519 |
| 5,259,529 | A | 11/1993 | Coale | |
| 5,524,817 | A * | 6/1996 | Meier et al. | 229/403 |
| 5,660,326 | A * | 8/1997 | Varano et al. | 229/403 |
| 5,685,480 | A * | 11/1997 | Choi | 229/403 |
| 5,752,653 | A * | 5/1998 | Razzaghi | 229/403 |
| 5,820,016 | A * | 10/1998 | Stropkay | 229/403 |
| 5,988,493 | A | 11/1999 | Clougherty | |
| 6,050,443 | A * | 4/2000 | Tung | 220/592.17 |
| 6,053,352 | A * | 4/2000 | Cai | 220/739 |
| 6,065,632 | A * | 5/2000 | Moore, Jr. | 220/483 |
| 6,119,889 | A * | 9/2000 | Fujii et al. | 220/592.27 |
| 6,138,862 | A * | 10/2000 | Tai | 220/592.17 |
| 6,367,652 | B1 * | 4/2002 | Toida et al. | 220/739 |
| 6,405,892 | B1 * | 6/2002 | Volan | 220/592.17 |
| 6,474,498 | B1 | 11/2002 | Markham | |
| 6,561,376 | B2 * | 5/2003 | Price et al. | 220/669 |
| 6,629,618 | B1 * | 10/2003 | Volan | 215/12.1 |
| 6,913,165 | B2 * | 7/2005 | Linz et al. | 220/568 |
| 6,915,917 | B2 * | 7/2005 | Watanabe et al. | 215/13.1 |
| 6,921,179 | B2 * | 7/2005 | Diak Ghanem | 362/84 |
| 7,168,583 | B2 * | 1/2007 | Freeman | 220/8 |
| 7,677,435 | B2 * | 3/2010 | Stahlecker | 229/403 |
| 7,699,216 | B2 * | 4/2010 | Smith et al. | 229/403 |
| 7,717,325 | B2 * | 5/2010 | Puls et al. | 229/403 |
| RE42,421 | E * | 6/2011 | Toida et al. | 220/739 |
| 8,056,757 | B2 | 11/2011 | Mansour et al. | |
| 8,141,740 | B2 * | 3/2012 | Agnello | 220/592.17 |
| 8,146,796 | B2 * | 4/2012 | D'Amato | 206/505 |
| 8,360,263 | B2 * | 1/2013 | D'Amato | 220/592.17 |
| 8,393,886 | B2 * | 3/2013 | D'Amato | 425/387.1 |
| 8,448,810 | B2 * | 5/2013 | Kelly et al. | 220/592.27 |
| 8,701,914 | B1 * | 4/2014 | Buck | 220/23.87 |
| 8,727,206 | B2 * | 5/2014 | Messerschmid et al. | 229/403 |
| 8,757,418 | B2 * | 6/2014 | Zimmerman et al. | 220/483 |
| 2004/0188450 | A1 * | 9/2004 | Marshall et al. | 220/737 |
| 2005/0184074 | A1 * | 8/2005 | Simmons et al. | 220/592.17 |
| 2006/0118608 | A1 * | 6/2006 | Stahlecker | 229/403 |
| 2006/0226210 | A1 * | 10/2006 | Stahlecker | 229/403 |
| 2007/0029276 | A1 * | 2/2007 | Clare | 215/395 |
| 2008/0128481 | A1 * | 6/2008 | Robertson | 229/403 |
| 2008/0302800 | A1 * | 12/2008 | Chou | 220/495.03 |
| 2010/0108693 | A1 * | 5/2010 | Zhang et al. | 220/592.2 |
| 2012/0111877 | A1 * | 5/2012 | Marshall | 220/674 |
| 2012/0223079 | A1 * | 9/2012 | Stern | 220/495.03 |
| 2012/0261427 | A1 * | 10/2012 | Bates | 220/592.17 |
| 2013/0119065 | A1 * | 5/2013 | Buck | 220/523 |
| 2013/0221013 | A1 * | 8/2013 | Kolowich et al. | 220/592.17 |
| 2013/0292392 | A1 * | 11/2013 | Cai et al. | 220/592.2 |

* cited by examiner

BEVERAGE CUP INSULATING SEAL MEMBER AND ASSOCIATED INSULATED BEVERAGE CUP ASSEMBLY

CROSS-REFERENCE TO RELATED APPLICATIONS

Not Applicable.

BACKGROUND OF THE INVENTION

1. Field of the Invention

The present invention relates in general to a seal member, and more particularly, to an insulating seal member for use in association with a plurality of beverage cups which cooperatively facilitate maintaining associated cold and warm beverages (e.g., water, pop, soda, beer, tea, coffee, hot chocolate, etcetera) below and above ambient temperatures, respectively, for extended periods of time.

2. Background Art

Insulators and seal members for use in association with beverage cups and associated assemblies have been known in the art for years and are the subject of numerous patents, including, but not limited to: U.S. Pat. No. 8,448,810 entitled "DOUBLE WALLED BEVERAGE CONTAINER AND METHOD OF MAKING SAME;" U.S. Pat. No. 8,056,757 entitled "HOT BEVERAGE CUP SLEEVE;" U.S. Pat. No. 6,474,498 entitled "THERMALLY INSULATED CONTAINERS FOR LIQUIDS;" U.S. Pat. No. 6,138,862 entitled "CUP STRUCTURE WITH HEAT ISOLATION EFFECT;" U.S. Pat. No. 5,988,493 entitled "COMPOSITE CONTAINER FOR VACUUM PACKAGING OF PRODUCTS;" U.S. Pat. No. 5,259,529 entitled "COLLAPSIBLE INSULATED RECEPTACLE FOR BEVERAGE CONTAINERS;" U.S. Pat. No. 4,993,580 entitled "INSULATED BEVERAGE CONTAINER;" U.S. Pat. No. 4,747,507 entitled "HOLDER FOR A CONTAINER;" U.S. Pat. No. 4,671,424 entitled "INSULATED CAN HOLDER;" and U.S. Pat. No. 4,534,391 entitled "BEVERAGE INSULATOR WITH ADVERTISING PANEL"—all of which are hereby incorporated herein by reference in their entirety, including all references cited therein.

U.S. Pat. No. 8,448,810 appears to disclose a double walled container for insulating a beverage. An outer insulating shell or container is secured to the inner container that holds the beverage. A gap exists between the outer container and inner container and the air in the gap acts as an insulating barrier. The inner container is preferably a standard aluminum container. The outer container is preferably made from aluminum or a plastic polymer. The outer container may have annular or longitudinal grooves that assist in securing the outer container to the inner container, and the grooves may also provide an enhanced gripping surface as well as a visually pleasing aesthetic design. The outer container may include a base, or the base may be eliminated in favor of a sleeve configuration for the outer container.

U.S. Pat. No. 8,056,757 appears to disclose a hot beverage cup and sleeve which bring together two modes of heat transfer, conduction and radiation. The sleeve has an inner face with a plurality of high reflectivity surfaces for radiating heat back to the cup. The sleeve also has a plurality of insulating members for containing insulating air. Each of the insulating members is positioned to space the high reflectivity surfaces away from the cup. A low emissivity film can be adhered to the cup without touching the insulating members. The film can also be attached to the sleeve facing but spaced from the high reflectivity surfaces. This cup and sleeve arrangement minimizes thermal contact and reduces heat transfer. Thus, the hot beverage cup and sleeve protect a person's hand as well as extend the time of keeping the beverage hot.

U.S. Pat. No. 6,474,498 appears to disclose containers for liquids, commonly dispensed for consumption at a temperature below ambient (such as chilled soft drink cans) that can be maintained for extended periods below ambient, after they have been dispensed from a refrigerated container, by providing a lining member formed from a plastic material having closed cells and providing insulating properties. The lining member may, for instance, have large cells and be dimensioned to fit within the shell of the container, or can be formed as a layer on the internal surface of the shell of the container.

U.S. Pat. No. 6,138,862 appears to disclose a cup structure with a heat isolation effect, thereby, if two cups according to the present invention are overlapped, the combined cups have a preferred heat isolation effect. The bottom of the cups are installed with respective isolation elements. When the user overlaps two cups, he (or she) can rotate the inner cup with an angle, so that the isolation element of the inner cup can rest against the isolation element of the outer cup. Therefore, by shielding the isolation element of the outer cup, the bottom of the inner cup cannot rest against the bottom of the outer cup, thus a space is formed therebetween. Especially, the handle on the lateral side of the cup has a preferred effect. Therefore, if a hot food is filled into the cup, because of the isolation of the space, the hot temperature of the inner cup cannot be transferred to the outer cup and thus the heat isolation effect is attained.

U.S. Pat. No. 5,988,493 appears to disclose a composite container for vacuum packaging of products which is constructed, as follows. A hollow body portion defines a desired shape for the container and has an inside surface. A liner layer is in a superimposed position within the body portion and covers the inside surface for receiving the product inside the liner layer and the body portion of the container. An elastic material is positioned between the body portion and the liner layer for movably attaching the liner layer to the body portion in the superimposed position while allowing the liner layer to constrict and move away from the body portion by stretching of the elastic material when a vacuum is formed on the product packaged in the container and then allowing the liner layer to move back into the superimposed position within the body portion of the container by retraction of the elastic material when the container is opened and the vacuum on the product is removed.

U.S. Pat. No. 5,259,529 appears to disclose a collapsible insulated receptacle for beverage containers which is constructed of material which is light weight, sturdy, recyclable, biodegradable, and provides a suitable medium for high quality color separation printing. The receptacle embraces the beverage container such that the consumer can maneuver the beverage container by maneuvering the receptacle. The receptacle is collapsible to a size which is easily and efficiently transported before sales or distribution and able to be transported by the consumer in a clothes pocket.

U.S. Pat. No. 4,993,580 appears to disclose a container organization including an exterior wall spaced from an interior wall defining a conical body formed with a reinforced rib at its upper end and a floor at its lower end. The body includes an insulated medium therebetween. The insulated medium includes circumferentially equally spaced ribs there along either alone or in association with a sinusoidal corrugating medium wherein the corrugating medium may be mounted directly to the ribs or spaced therefrom by an intermediate wall. A plurality of insulated mediums may be utilized offset relative to one another by one-half amplitude relative to one another to effect adhesive contact between upper and lower peaks of respective lower and upper sinusoidal corrugating mediums. Further, a single sinusoidal medium may be utilized spaced from the interior and exterior walls by offset ribs adhesively mounted to alternating upper and lower peaks of the corrugating medium.

U.S. Pat. No. 4,747,507 appears to disclose a molded container for a bottle, the container is of double wall construction so as to provide good thermal insulation and the bottom of the container has a castellated opening or recess into which the crown seal of a bottle can be inserted for facilitating removal of the crown seal of the bottle. Also disclosed is an injection molding die for forming a double walled container.

U.S. Pat. No. 4,671,424 appears to disclose an insulated can holder defined by an outer shell of a moldable, resilient plastic material and an inner, removable insulating liner inside of the outer shell. The shell carries at least one flat, indicia bearing and integral portion whose interior surface bears against the insulating liner to thereby define a non-circular cross section of the holder and thereby increase the contact and friction between a can and the liner.

U.S. Pat. No. 4,534,391 appears to disclose a one-piece plastic insulated beverage receptacle holder having longitudinal side panels, one of which is wider than the remainder and recessed to accommodate ad copy or the like.

While insulators and seal members for use in association with beverage containers are commercially available, problems associated with simplicity, portability, cost, and beverage temperature regulation remain problematic.

It is therefore an object of the present invention to provide an insulating seal member for use in association with a plurality of beverage cups which remedies the detriments and/or complications associated with conventional seals, insulators and/or insulating configurations known in the art.

It is therefore a further object of the present invention to provide an insulating seal member assembly in combination with a pair of cups which remedies the detriments and/or complications associated with conventional seals, insulators and/or insulating configurations known in the art.

These and other objects of the present invention will become apparent in light of the present specification, claims, and drawings.

SUMMARY OF THE INVENTION

The present invention is directed to, in one embodiment, an insulating seal member adapted for use in association with a pair of beverage cups comprising, consisting essentially of, and/or consisting of: (a) an annular body, wherein the annular body comprises: (1) an upper region having an inner surface, an outer surface, and a top surface; (2) a lower region having an inner surface, an outer surface, and a bottom surface; and (3) an intermediate region positioned between the upper and lower regions; (b) wherein the top surface of the upper region is adapted to sealingly engage a bottom surface of an annular rim of a first beverage cup; and (c) wherein the lower surface of the intermediate region is adapted to sealingly engage a top surface of an annular rim of a second beverage cup positioned below the first beverage cup.

In one embodiment of the present invention, the intermediate region includes an upper surface positioned inside of the top surface of the upper region, and the intermediate region further includes a lower surface positioned outside of the bottom surface of the lower region.

In a preferred embodiment of the present invention, the upper region and the intermediate region of the insulating seal member and the sidewall of the first beverage cup form an upper cavity therebetween.

In another preferred embodiment of the present invention, the outer surface of the upper region comprises indicia.

In yet another preferred embodiment of the present invention, the insulating seal member is fabricated from at least one of the group consisting of a silicone, a urethane, a santoprene, a natural rubber, a synthetic rubber, an injection molding resin and combinations thereof.

In another aspect of the present invention, the insulating seal member is fabricated from at least one of the group consisting of a silane polymer, a siloxane polymer and combinations thereof.

The present invention is also directed to, in one embodiment, an insulated beverage cup assembly for maintaining associated cold beverages below ambient temperatures for extended periods of time and for maintaining associated warm beverages above ambient temperatures for extended periods of time, comprising, consisting essentially of and/or consisting of: (a) a first beverage cup having a beverage containment region defined by a bottom wall having an inner surface and an outer surface, an annular sidewall having an inner surface and an outer surface, and an upper annular rim having an upper surface and a lower surface; (b) a second beverage cup having a beverage containment region defined by a bottom wall having an inner surface and an outer surface, an annular sidewall having an inner surface and an outer surface, and an upper annular rim having an upper surface and a lower surface; and (c) an insulating seal member positioned between the upper annular rim of the first beverage cup and the upper annular rim of the second beverage cup.

In a preferred embodiment of the present invention, the insulating seal member includes a top surface, a bottom surface, an inner surface, and an outer surface, wherein the insulating seal member is positioned between the upper annular rim of the first beverage cup and the upper annular rim of the second beverage cup which creates a vertical separation between the first and second beverage cups to, in turn, form an insulating cavity therebetween.

BRIEF DESCRIPTION OF THE DRAWINGS

The invention will now be described with reference to the drawings wherein.

DETAILED DESCRIPTION OF THE INVENTION

Figure 1:
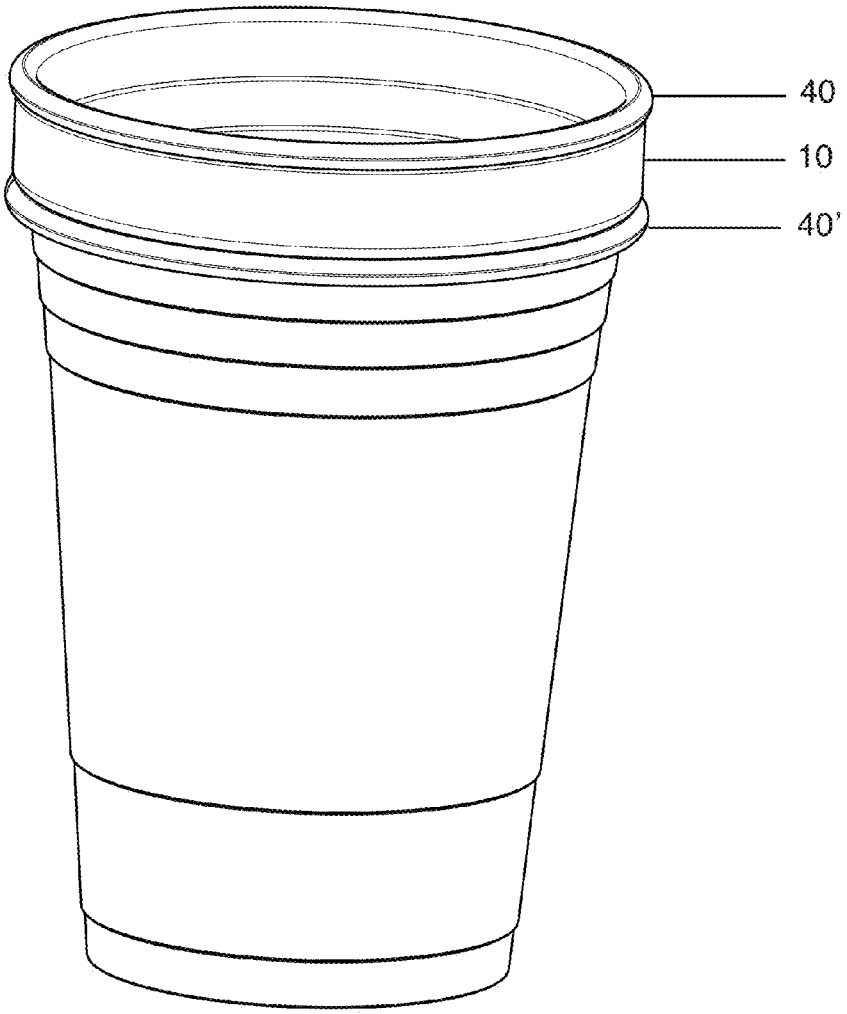
FIG. 1 of the drawings is an isometric view illustrating an assembled, insulated beverage cup assembly comprising a pair of beverage cups and a beverage cup insulating seal member.

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. In addition, it will be understood that the drawings are merely schematic representations of an embodiment of the invention, and some of the components may have been distorted from their actual scale for purposes of pictorial clarity.

Referring now to the drawings, and to FIGS. 1 and 2A-2C in particular, insulating seal member 10 is shown which is adapted for use in association with a pair of beverage cups 40 and 40' (e.g., SOLO® brand disposable cups). In one embodiment, insulating seal member 10 generally comprises annular body 12 having upper region 14, lower region 16, and intermediate region 18.

Upper region 14 includes inner surface 20, outer surface 22, and top surface 24. Lower region 16 includes inner surface 26, outer surface 28, and bottom surface 30 which collectively form a centering flange. Intermediate region 18 is positioned between the upper and lower regions 14 and 16, respectively, and includes upper surface 32 positioned inside of top surface 24 of upper region 14, and lower surface 34 positioned outside of bottom surface 30 of lower region 16.

Figure 2A:
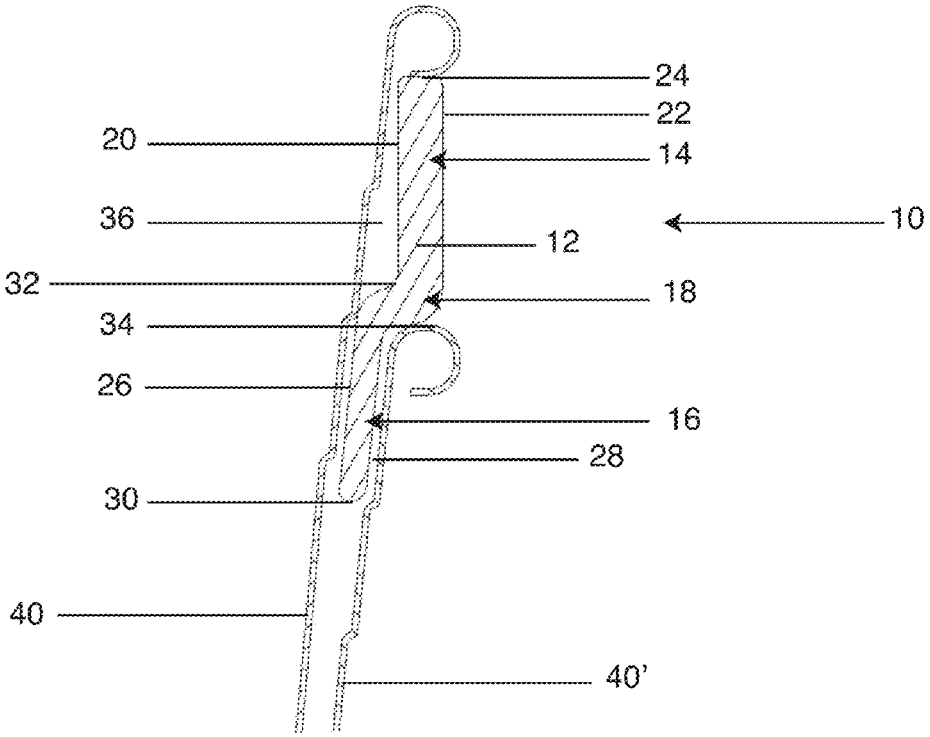
FIG. 2A of the drawings is a fragmented cross-sectional view illustrating an assembled, insulated beverage cup assembly comprising a beverage cup insulating seal member positioned between a pair of beverage cups.
Figure 2B:
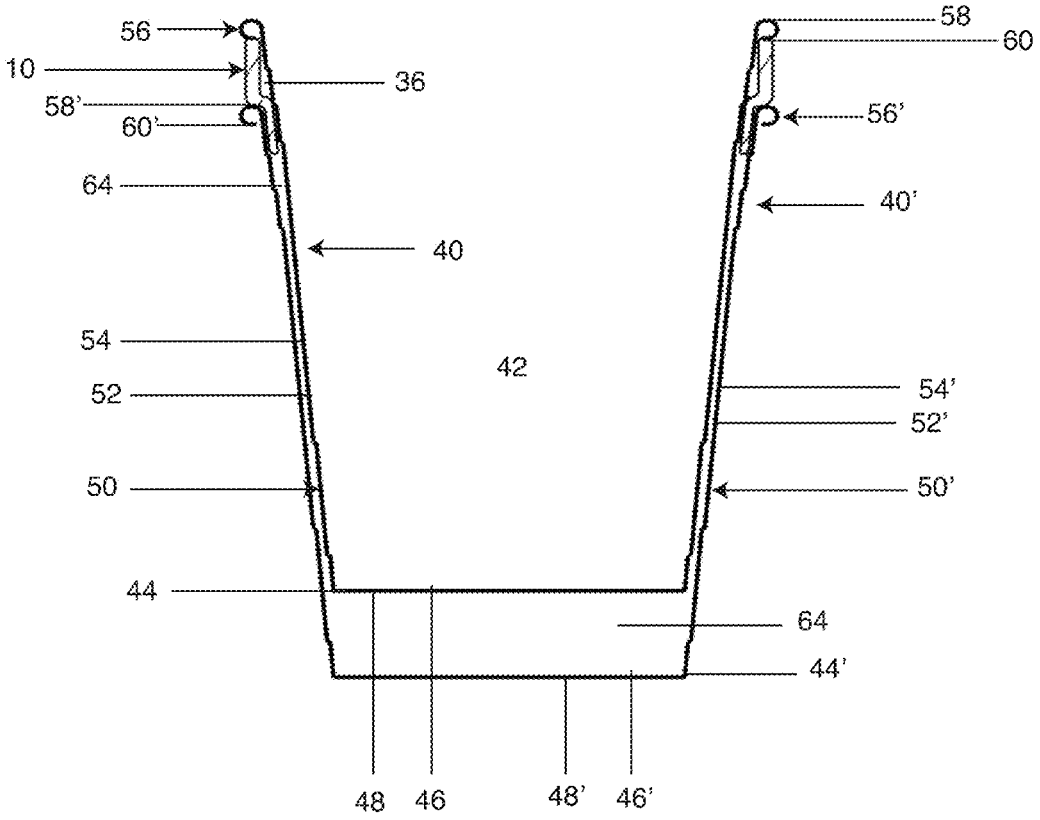
FIG. 2B of the drawings is a cross-sectional view illustrating an assembled, insulated beverage cup assembly comprising a beverage cup insulating seal member positioned between a pair of beverage cups.

As is best shown in FIGS. 2A and 2B, and as will be discussed in greater detail below, top surface 24 of upper region 14 preferably sealingly engages bottom surface 60 of annular rim 56 of first beverage cup 40, and lower surface 34 of intermediate region 18 preferably sealingly engages top surface 58' of annular rim 56' of second beverage cup 40' positioned below first beverage cup 40.

Referring once again to FIGS. 2A and 2B, upper region 14 and intermediate region 18 of insulating seal member 10 and sidewall 50 of first beverage cup 40 form upper cavity 36 therebetween. In certain embodiments of the present invention, upper cavity 36 serves as an insulating cavity which is useful when hot beverages are contained within first beverage cup 40.

Figure 3:
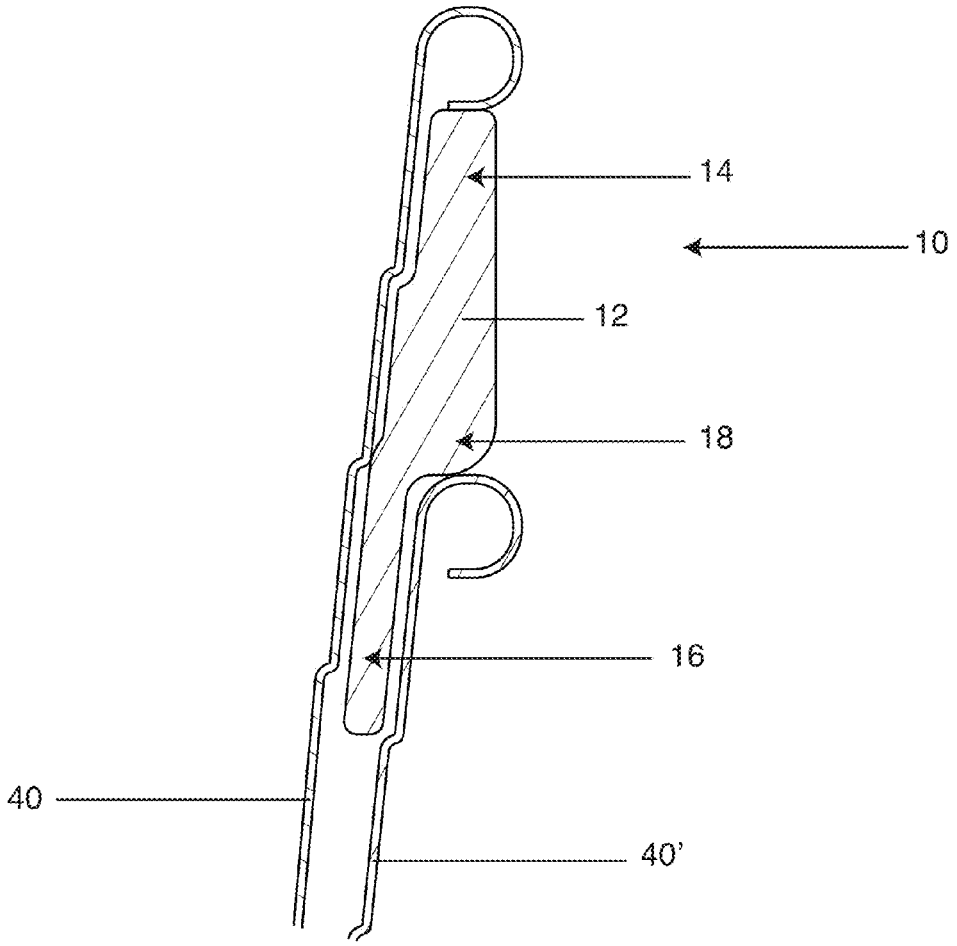
FIG. 3 of the drawings is a fragmented cross-sectional view illustrating an alternative embodiment of an assembled, insulated beverage cup assembly comprising a beverage cup insulating seal member positioned between a pair of beverage cups.

Referring now to FIG. 3, in one embodiment of the present invention, insulating seal member 10 generally comprises annular body 12 having upper region 14, lower region 16, and intermediate region 18. In this embodiment upper cavity 36 is void, non-existent, and/or at least partially occupied by the outer peripheral geometry of annular body 12.

Figure 4:
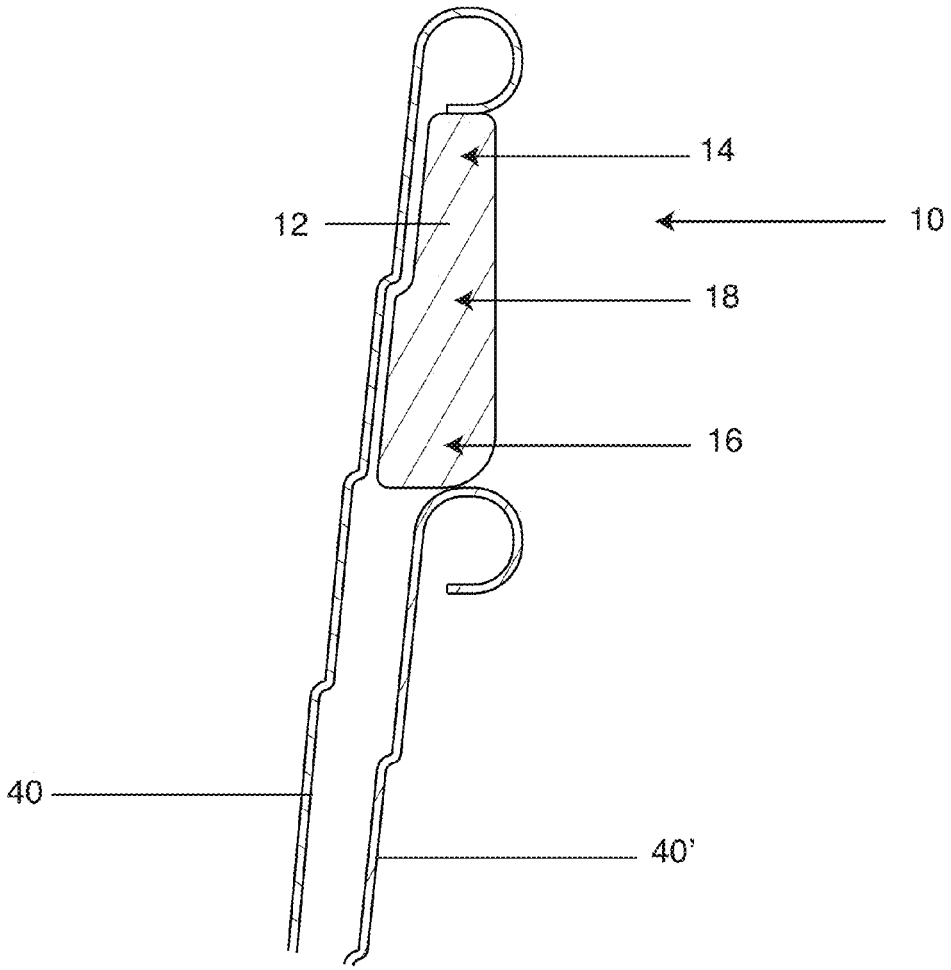
FIG. 4 of the drawings is a fragmented cross-sectional view illustrating an additional alternative embodiment of an assembled, insulated beverage cup assembly comprising a beverage cup insulating seal member positioned between a pair of beverage cups.

Referring now to FIG. 4, in another embodiment of the present invention, insulating seal member 10 generally comprises annular body 12 having upper region 14, lower region 16 which is void of a centering flange, and intermediate region 18. Similar to the embodiment shown in FIG. 3, upper cavity 36 is void, non-existent, and/or at least partially occupied by the outer peripheral geometry of annular body 12.

Figure 5:
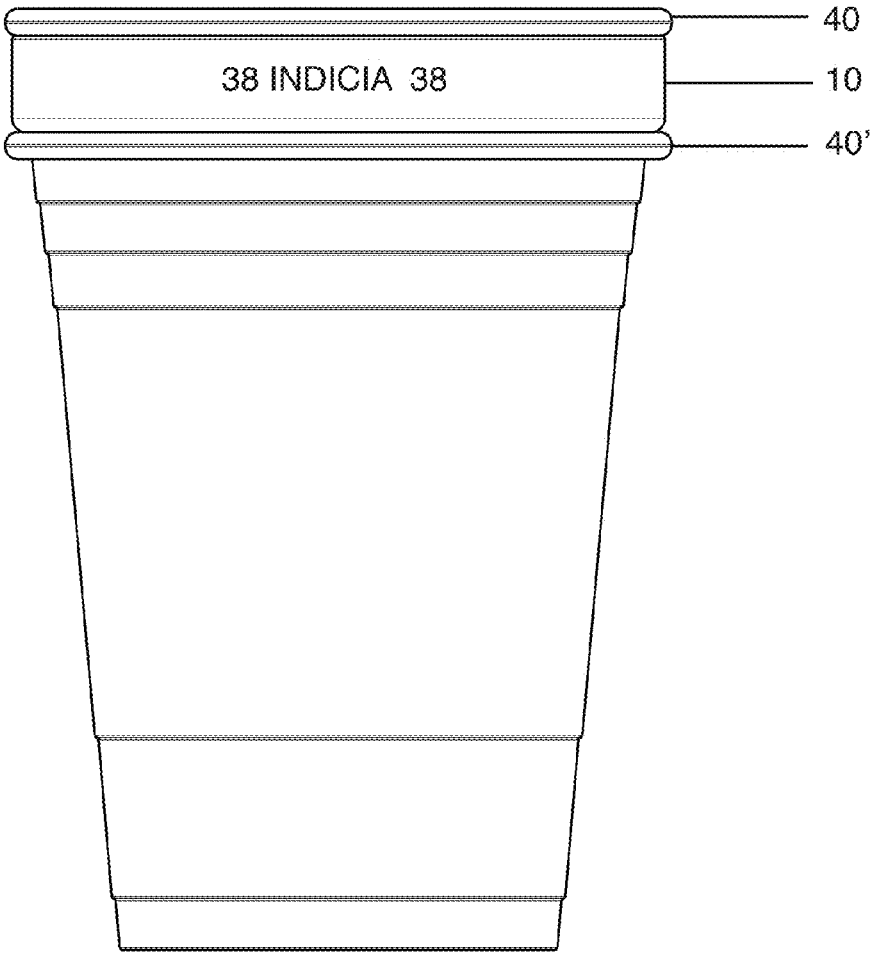
FIG. 5 of the drawings is a side-elevation view of a beverage cup assembly comprising a pair of beverage cups and a beverage cup insulating seal member associated with indicia.

As is best shown in FIG. 5, outer surface 22 of upper region 14 optionally comprises indicia 38. For purposes of the present disclosure, indicia 38 may comprise any one of a number of marks, such as alphanumeric characters, terms, phrases, slogans, emoticons, sports symbols and/or mascots, etcetera.

It will be understood that insulating seal member 10 is preferably fabricated from at least one of the group consisting of a silicone, a urethane, a santoprene, a natural rubber, a synthetic rubber, an injection molding resin and combinations thereof. In certain embodiments, insulating seal member 10 is more preferably fabricated from at least one of the group consisting of a silane polymer, a siloxane polymer and combinations thereof. While particular insulating seal member materials have been disclosed, for illustrative purposes only, it will be understood that numerous other insulating seal member materials are likewise contemplated for use—so long as the materials are food grade and/or safe for interaction with the mouth of a human.

Figure 2C:
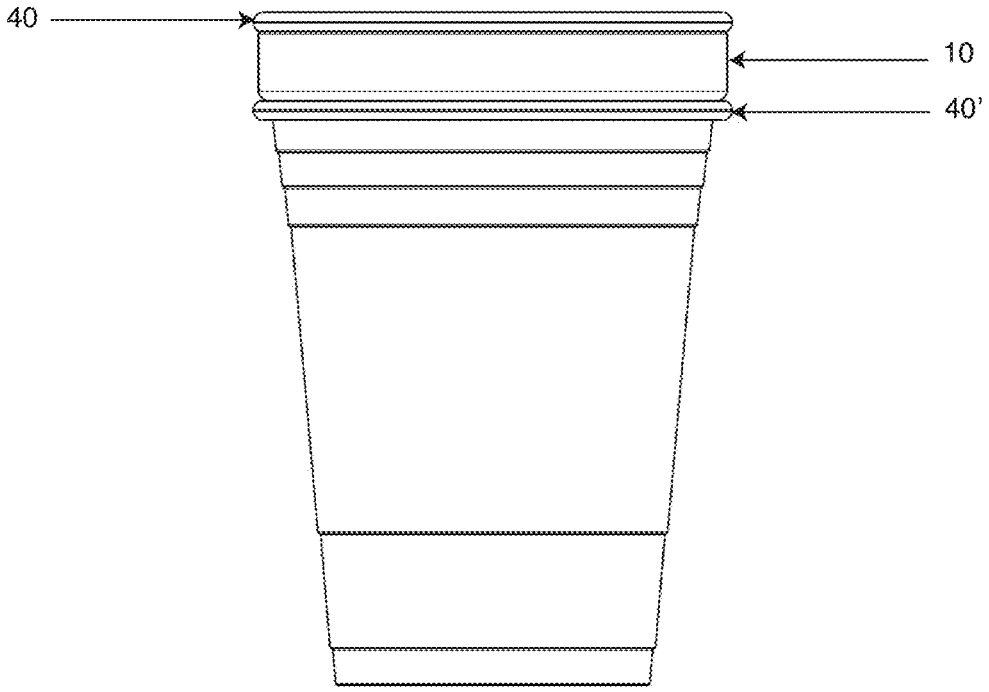
FIG. 2C of the drawings is a side-elevation view illustrating an assembled, insulated beverage cup assembly comprising a beverage cup insulating seal member positioned between a pair of beverage cups.

As is best shown in FIGS. 2A-2C, the present invention is also directed to an insulated beverage cup assembly for maintaining associated cold beverages below ambient temperatures for extended periods of time and/or for maintaining associated warm beverages above ambient temperatures for extended periods of time, comprising: first beverage cup 40 having beverage containment region 42 defined by bottom wall 44 having inner surface 46 and outer surface 48, annular sidewall 50 having inner surface 52 and outer surface 54, and upper annular rim 56 having upper surface 58 and a lower surface 60; second beverage cup 40' which is similar to and/or the same as first beverage cup 40 (second beverage cup elements are denoted with prime (') numbers); and insulating seal member 10 which is positioned between upper annular rim 56 of first beverage cup 40 and upper annular rim 56' of second beverage cup 40'.

Figure 6:
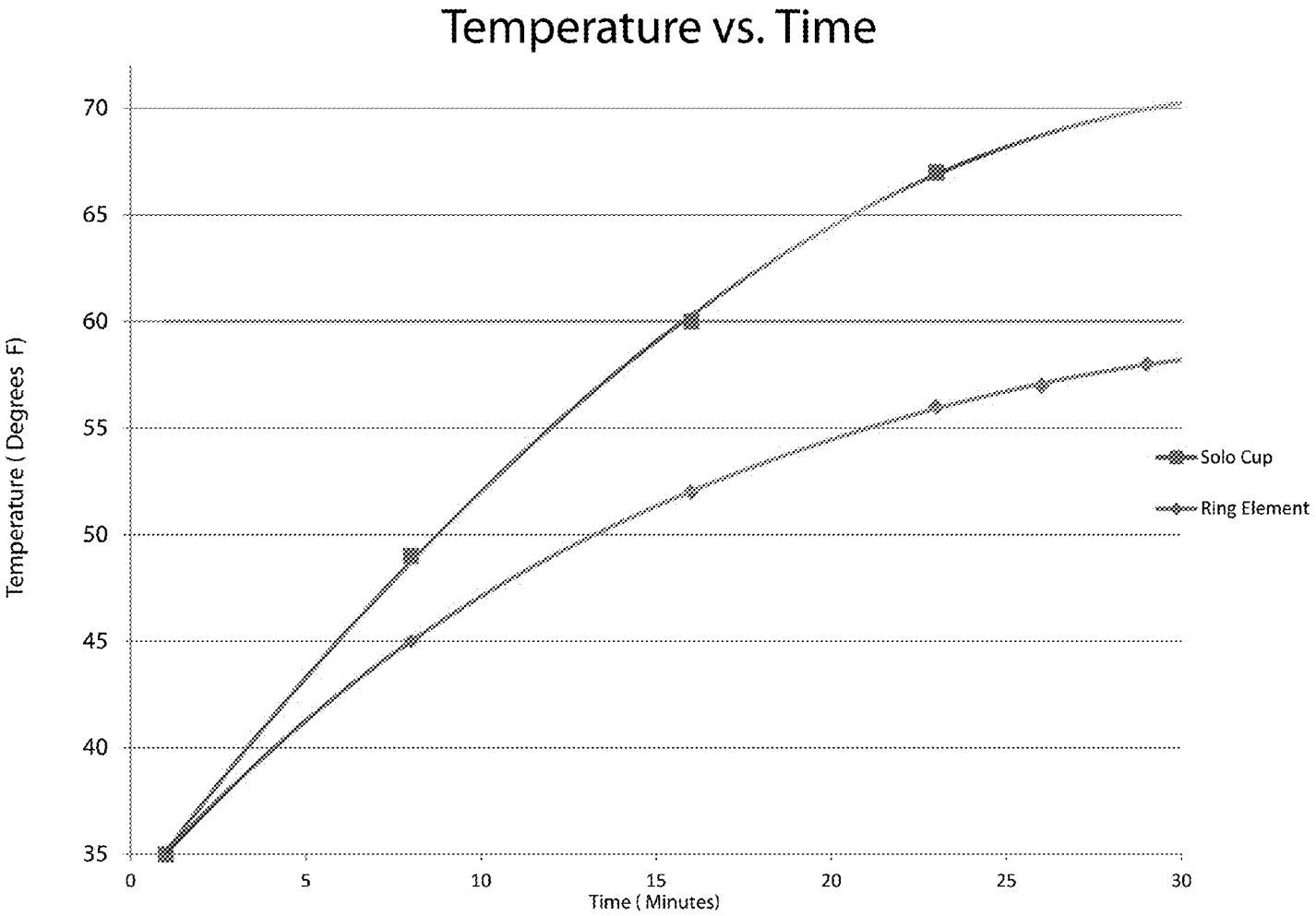
FIG. 6 of the drawings is a two-dimensional plot showing temperature change as a function of exposure time to ambient temperatures for two different beverage cup configurations.

It will be understood that due to the tapered design of stackable drinking cups 40 and 40', a vertical separation exists because insulating seal member 10 is placed between the two cups which results in radial air gap 64. Radial air gap 64 creates an effective insulating property, and therefore, helps to maintain associated cold beverages below ambient temperatures for extended periods of time, as well as maintain associated warm beverages above ambient temperatures for extended periods of time. FIG. 6 shows a test conducted in an ambient air temperature of 84 degrees Fahrenheit, with liquid added to each cup at approximately 37 degrees Fahrenheit. The results shown clearly demonstrate the insulating performance of two cups separated by the insulating seal member compared to a single cup for a period of approximately 30 minutes.

In accordance with the present invention, insulating seal member 10 is small enough to allow a user to carry it in a pocket or purse, wear on their wrist, or carry by other means. The simple and small design makes it possible to manufacture the seal member at a very low cost, lower than other items used for similar purposes.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. An insulated beverage cup assembly for maintaining associated cold beverages below ambient temperatures for extended periods of time and for maintaining associated warm beverages above ambient temperatures for extended periods of time, consisting of:

a first beverage cup having a beverage containment region defined by a bottom wall having an inner surface and an outer surface, an annular sidewall having an inner surface and an outer surface, and an upper annular rim having an top surface and a bottom surface;

a second beverage cup having a beverage containment region defined by a bottom wall having an inner surface and an outer surface, an annular sidewall having an inner surface and an outer surface, and an upper annular rim having an top surface and a bottom surface; and an insulating seal member positioned between the upper annular rim of the first beverage cup and the upper annular rim of the second beverage cup, wherein the insulating seal member consists of:

an annular body, wherein the annular body consists of:

an upper region having an inner surface, an outer surface, and a top surface;

a lower region having an inner surface, an outer surface, and a bottom surface, wherein the inner surface, the outer surface, and the bottom surface of the lower region is void of contact with the first and second beverage cup;

an intermediate region positioned between the upper and lower regions, and wherein the upper region, the lower region and the intermediate region of the annular body consist of a siloxane polymer;

wherein the top surface of the upper region sealingly engages the bottom surface of the upper annular rim of the first beverage cup; and wherein the lower surface of the intermediate region sealingly engages the top surface of the upper annular rim of a second beverage cup positioned below the first beverage cup.

* * * * *